US009206757B2

(12) United States Patent
Matuoka et al.

(10) Patent No.: US 9,206,757 B2
(45) Date of Patent: Dec. 8, 2015

(54) PARTICULATE DETECTION SYSTEM

(75) Inventors: Toshiya Matuoka, Kaizu (JP); Masayuki Motomura, Komaki (JP); Takeshi Sugiyama, Gifu-ken (JP); Keisuke Tashima, Kasugai (JP); Hitoshi Yokoi, Ama (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 684 days.

(21) Appl. No.: 13/468,729

(22) Filed: May 10, 2012

(65) Prior Publication Data

US 2012/0285219 A1 Nov. 15, 2012

(30) Foreign Application Priority Data

May 11, 2011 (JP) ..... 2011-106662

(51) Int. Cl.
*F02D 41/14* (2006.01)
*F02D 41/22* (2006.01)
*F02D 41/06* (2006.01)

(52) U.S. Cl.
CPC ..... *F02D 41/1466* (2013.01); *F01N 2560/05* (2013.01); *F02D 41/062* (2013.01); *F02D 41/222* (2013.01)

(58) Field of Classification Search
CPC ..... F02D 41/029; F02D 2200/0812; F02D 41/1466; F01N 2560/05; F01N 11/00; F01N 9/002
See application file for complete search history.

(56) References Cited

U.S. PATENT DOCUMENTS

| | | | | |
|---|---|---|---|---|
| 6,016,688 | A * | 1/2000 | Hiss et al. | 73/28.01 |
| 8,479,494 | B2 | 7/2013 | Enomoto et al. | |
| 2010/0300068 | A1 | 12/2010 | Enomoto et al. | |
| 2011/0047978 | A1 | 3/2011 | Zawacki et al. | |
| 2011/0050243 | A1 | 3/2011 | Tikkanen | |
| 2011/0314796 | A1* | 12/2011 | Nakamura et al. | 60/276 |
| 2011/0320171 | A1 | 12/2011 | Okayama et al. | |
| 2012/0234172 | A1* | 9/2012 | Sugiyama et al. | 96/26 |

FOREIGN PATENT DOCUMENTS

| | | | |
|---|---|---|---|
| DE | 10 2009 001 064 | A1 | 8/2010 |
| JP | 2007-171001 | A | 7/2007 |

(Continued)

OTHER PUBLICATIONS

Extended European Search Report dated Jun. 4, 2013 for corresponding European patent application No. 12003760.

(Continued)

*Primary Examiner* — Lisa Caputo
*Assistant Examiner* — Punam Roy
(74) *Attorney, Agent, or Firm* — Sughrue Mion, PLLC

(57) ABSTRACT

A particulate detection system (1, 2, 3) detects the quantity of particulates S contained in exhaust gas EG discharged from an internal combustion engine ENG and flowing through an exhaust pipe EP. The system (1, 2, 3) includes a detection section (10) attached to the exhaust pipe EP; and a drive processing circuit (201) electrically connected to the detection section (10), driving the detection section (10), and detecting and processing a signal Is from the detection section 10. The drive processing circuit (201) includes drive start delay means (S2, S3, S11, S12, S13, S22, S23) for delaying start of the drive of the detection section (10) until a start condition determined by the drive processing circuit (201) is satisfied after startup of the internal combustion engine ENG.

7 Claims, 6 Drawing Sheets

(56) References Cited

FOREIGN PATENT DOCUMENTS

| | | | |
|---|---|---|---|
| JP | 2009-222424 | A | 10/2009 |
| JP | 2009-228564 | A | 10/2009 |
| JP | 2011-21479 | A | 2/2011 |
| JP | 2011-513742 | A | 4/2011 |
| WO | 2009/109688 | A1 | 9/2009 |
| WO | 2009/112947 | A2 | 9/2009 |

OTHER PUBLICATIONS

Japanese Office Action mailed on Jan. 14, 2014 in relevant Japanese patent application No. 2011-106662.

* cited by examiner

PARTICULATE DETECTION SYSTEM

BACKGROUND OF THE INVENTION

1. Field of the Invention

The present invention relates to a particulate detection system (hereinafter also referred to a "system") for detecting the quantity of particulates contained in exhaust gas which flows through an exhaust pipe.

2. Description of the Related Art

The exhaust gas of an internal combustion engine (for example, a diesel engine or a gasoline engine) may contain particulates such as soot.

Exhaust gas containing such particulates is purified by collecting the particulates through use of a filter. When necessary, the filter is heated to a high temperature so as to burn particulates accumulated on the filter, to thereby remove the particulates. Therefore, when a failure such as breakage of the filter occurs, unpurified exhaust gas is discharged directly to the downstream of the filter.

Therefore, there has been a demand for a particulate detection system which can detect the quantity of particulates contained in exhaust gas in order to directly measure the quantity of particulates contained in (unpurified) exhaust gas or detect a failure of the filter.

For example, Patent Document 1 discloses a particular measurement method and apparatus. Namely, Patent Document 1 discloses a method of mixing an ionized gas which contains positive ions with exhaust gas which is introduced from an exhaust pipe into a channel and which contains particulates to thereby charge the particulates, and then releasing the charged particulates to the exhaust pipe. The method detects a current (signal current) which flows in accordance with the quantity of the released, charged particulates, to thereby detect the concentration of the particulates.

As described above, in the particulate detection system, a detection section is attached to an exhaust pipe, and exhaust gas is introduced into the detection section so as to detect particulates contained in the exhaust gas within the exhaust pipe. Therefore, a portion of the detection section is placed in a state in which that portion communicates with the inner space of the exhaust pipe.

[Patent Document 1] WO2009/109688

3. Problems to be Solved by the Invention

Since an internal combustion engine or an exhaust pipe is cooled after a previous operation of the internal combustion engine, depending on the outside air temperature, condensed water may accumulate within the exhaust pipe or the housing of a turbo charger. Therefore, for a short time after startup of the internal combustion engine, exhaust gas may contain water droplets. Also, condensed water may be present inside or around the detection section itself before startup of the internal combustion engine. That is, the detection section may be placed in a state in which water droplets adhere thereto before startup of the internal combustion engine or thereafter. Notably, the water droplets adhering to the detection section evaporate when, upon elapse of time from startup of the internal combustion engine, the temperature of the internal combustion engine increases, or the temperatures of the exhaust pipe and the detection section increase due to heating by exhaust gas.

However, in the case where water droplets remain on the detection section, depending on the position where the water droplets adhere to the detection section, the water droplets may lower the insulation resistance between the constituent members of the detection section. If a drive processing circuit starts drive of the detection section and applies a voltage thereto in a state in which the insulation resistance between the constituent members has been lowered, an undesirable current flows. Thus, the load acting on a power supply current within the drive processing circuit may become excessive. Further, operations such as discharge at the detection section become unstable, whereby proper detection may become impossible. Also, since water droplets adhere to the surface of an insulating member, which provides electrical insulation, a current flows between members which are to be insulated from each other by the insulating member, whereby migration occurs. In such a case, a current path is formed on the surface of the insulating member, and the insulation resistance is permanently decreased. Thus, a problem or failure such as degradation of the function of the detection section may occur.

SUMMARY OF THE INVENTION

The present invention has been accomplished in view of the above problems, and an object thereof is to provide a particulate detection system which can restrain or prevent the occurrence of problems (failures) caused by adhesion of water droplets to a detection section of the particulate detection system.

The above object of the invention has been achieved by providing (1) a particulate detection system for detecting a quantity of particulates contained in exhaust gas which is discharged from an internal combustion engine and flows through an exhaust pipe, comprising a detection section attached to the exhaust pipe; and a drive processing circuit electrically connected to the detection section, driving the detection section, and detecting and processing an output signal from the detection section, wherein the drive processing circuit includes drive start delay means for delaying start of the drive of the detection section until a start condition determined by the drive processing circuit is satisfied after startup of the internal combustion engine.

In the above-described particulate detection system, the drive start delay means delays the start of the drive of the detection section until the start condition determined by the drive processing circuit is satisfied. Therefore, problems which occur as a result of adhesion of water droplets to the detection section can be restrained or prevented. This is in contrast to the case where the drive of the detection section is started immediately after startup of the drive processing circuit (without determining whether or not the internal combustion engine has been started or without consideration of the time elapsed after startup of the engine).

Preferably, the start condition determined by the drive processing circuit is elapse of a wait time after startup of the internal combustion engine (complete ignition of the internal combustion engine), which wait time may be fixed or determined on the basis of information such as outside air temperature detected by an outside air temperature sensor. This is because the quantity of water droplets adhering to the detection section decreases with time through evaporation or the like. Upon elapse of the wait time, the drive processing circuit starts the drive of the detection section.

Alternatively, the start condition may be such that the exhaust gas temperature detected by an exhaust gas temperature sensor attached to the exhaust pipe or the temperature of the detection section detected by a temperature sensor provided on the detection section reaches a predetermined level, or such that the combination of conditions detected by various sensors satisfies a predetermined condition. In this case, when the exhaust gas temperature or the like reaches the predetermined level and the start condition is satisfied, the drive processing circuit starts the drive of the detection section.

In this case, preferably, the drive processing circuit sets the start condition as follows. The drive processing circuit obtains information from a sensor (e.g., an outside air temperature sensor for detecting the temperature of outside air, a water temperature sensor for detecting the temperature of cooling water of the internal combustion engine, or a temperature sensor for detecting the temperature of the detection section), the information allowing evaluation of the possibility of generation of condensed water or the possibility of adhesion of water droplets to the detection section; and the drive processing circuit sets the start condition on the basis of the information thus obtained.

Alternately, the drive processing circuit may determine whether or not the start condition is satisfied, as follows. The drive processing circuit obtains information from a sensor (e.g., the water temperature sensor, the exhaust gas temperature sensor, or the temperature sensor for detecting the temperature of the detection section), the information allowing evaluation of the possibility of disappearance of condensed water (if any) after startup of the internal combustion engine, and, on the basis of the obtained information, the drive processing circuit determines whether or not the start condition has been satisfied.

Notably, satisfaction of the start condition may be determined by combining outputs of a plurality of sensors.

In a preferred embodiment (2) of the particulate detection system (1) above, preferably, the start condition is a period passage condition which is satisfied when a time elapsed after startup of the drive processing circuit exceeds a wait time determined by the drive processing circuit; and the drive start delay means includes period determination means for determining whether or not the period passage condition is satisfied, by determining whether or not the elapse time exceeds the wait time.

In the present system, the start condition of the drive start delay means is the above-mentioned period passage condition, and the drive start delay means includes the period determination means for determining whether or not the period passage condition is satisfied, by determining whether or not the elapse time exceeds the wait time. Therefore, in the present system, passage of the wait time can be detected by the period determination means of the drive start delay means. Therefore, processing is relatively easy.

Notably, the wait time may be a fixed time (e.g., 60 sec), or may be changed in accordance with, for example, the outside air temperature immediately after the startup of the internal combustion engine (for example, when the outside air temperature is equal to lower than −10° C., the wait time is set to 60 sec; when the outside air temperature is 10° C. to −10° C., the wait time is set to 30 sec; when the outside air temperature is 10° C. to 20° C., the wait time is set to 15 sec; and when the outside air temperature is higher than 20° C., the wait time is set to 0 sec (i.e., the drive is started immediately)).

Preferably, the drive processing circuit changes the wait time as follows. The drive processing circuit obtains information (adhesion possibility information) from a sensor (e.g., the outside air temperature sensor, the water temperature sensor, or the like) which provides information (the outside air temperature, the water temperature of the internal combustion engine, etc.) which enables estimation of the possibility of generation of condensed water or the possibility of adhesion of water droplets to the detection section, and the drive processing circuit determines the length of the wait time (for example, determines to wait, on this occasion, for 60 sec after startup of the internal combustion engine) on the basis of the information thus obtained.

Alternatively, the drive processing circuit may determine the length of the wait time on the basis of information from a sensor of the detection section of the particulate detection system (e.g., a temperature sensor which is separately provided on the detection section so as to detect the temperature of the detection section). Also, the length of the wait time may be determined by combining information data obtained from a plurality of sensors.

The beginning of the wait time (the start point of time clocking) may be set to the timing at which the internal combustion engine starts (at the time of complete ignition of the internal combustion engine), the timing at which a switch (key switch) for starting operation of the internal combustion engine is turned to the ON position, or the timing at which a step of starting a timer for clocking the elapse time is executed when a processing program of the particulate detection system (the drive processing circuit) is started.

In another preferred embodiment (3) of the particulate detection system (2) above, preferably, the drive processing circuit includes adhesion information input means for receiving adhesion possibility information output from a sensor, the adhesion possibility information allowing evaluation of possibility of adhesion of water droplets to the detection section; and the drive start delay means includes wait length determination means for determining the length of the wait time associated with the period passage condition on the basis of the adhesion possibility information.

As described above, a requirement of the particulate detection system is required to restrain or prevent the occurrence of problems caused by adhesion of water droplets to the detection section. Meanwhile, the particulate detection system is required to start the detection of particulates at an early stage after startup of the internal combustion engine.

In this system, the drive processing circuit includes the adhesion information input means, and the drive start delay means includes the wait length determination means. Therefore, the length of the wait time can be properly determined on the basis of the adhesion possibility information from the sensor. Thus, it becomes possible to start the drive of the detection section at a proper timing as early as possible, while restraining or preventing occurrence of problems caused by adhesion of water droplets to the detection section.

Notably, examples of the adhesion possibility information, on the basis of which the possibility of adhesion of water droplets to the detection section can be evaluated, include the outside air temperature, the water temperature of the internal combustion engine, and the temperature of the detection section itself, on the basis of which the possibility of generation of condensed water can be examined. Examples of the sensor which outputs such adhesion possibility information include the outside air temperature sensor, the water temperature sensor, and the temperature sensor for detecting the temperature of the detection section.

In yet another preferred embodiment (4) of the particulate detection system (1) above, the drive processing circuit includes disappearance information input means for receiving disappearance possibility information output from a sensor, the disappearance possibility information allowing evaluation of possibility of disappearance of water droplets adhering to the detection section; and the drive start delay means includes determination means for determining whether or not the start condition is satisfied on the basis of the disappearance possibility information.

In this particulate detection system, the drive processing circuit includes disappearance information input means, and the drive start delay means includes the determination means. As described above, in the present system, the determination as to whether to start the drive of the detection section can be made on the basis of the disappearance possibility information from the sensor. Thus, it becomes possible to start the drive of the detection section at a proper timing as early as possible, while restraining or preventing the occurrence of problems caused by adhesion of water droplets to the detection section.

Notably, the disappearance possibility information, on the basis of which the possibility of disappearance of water droplets adhering to the detection section can be evaluated, is information which allows the system to estimate that condensed water adhering to the detection section has decreased or disappeared due to an increase in the temperature of the internal combustion engine, the exhaust pipe, or the detection section. Examples of such information include the water temperature of the internal combustion engine, the temperature of exhaust gas, and the temperature of the detection section itself. Examples of the sensor which outputs such disappearance possibility information include the water temperature sensor, the exhaust gas temperature sensor, and the temperature sensor for detecting the temperature of the detection section.

In addition thereto, the determination may be made in consideration of the time that has elapsed after startup of the internal combustion engine.

In yet another preferred embodiment (5) of any of the above-described particulate detection systems (1) to (4) above, a gas feed means is provided for feeding a gas to an in-pipe detection portion of the detection section, which portion is located within the exhaust pipe or faces the interior of the exhaust pipe, wherein the gas feed means starts feeding of the gas before the detection section is driven.

The present system includes a gas feed means that feeds an external gas to the detection section, and starts the feeding of the gas before the drive of the detection section is started. Even in the case where water droplets are present within the detection section, as a result of the air feeding, the water droplets can be effectively discharged to the outside of the detection section, and the water droplets can be evaporated and removed quickly. Thus, it becomes possible to restrain or prevent problems which are caused by water droplets remaining in the detection section.

Notably, the timing before starting the drive of the detection section may be the same timing as the startup of the system (the drive processing circuit) or the startup of the internal combustion engine. Alternatively, the timing before starting the drive of the detection section may be after the startup of the drive processing circuit or after the startup of the internal combustion engine.

Examples of the gas to be fed include air (outside air), nitrogen gas, and carbon dioxide gas. In the case where air is used, preferably, a pump is used as the gas feed means so as to feed atmospheric air around the pump. In the case where nitrogen or carbon dioxide is used, the gas can be fed through use of the pressure of the gas that has been charged into a cylinder under pressure.

DESCRIPTION OF REFERENCE NUMERALS AND SYMBOLS

Figure 1:
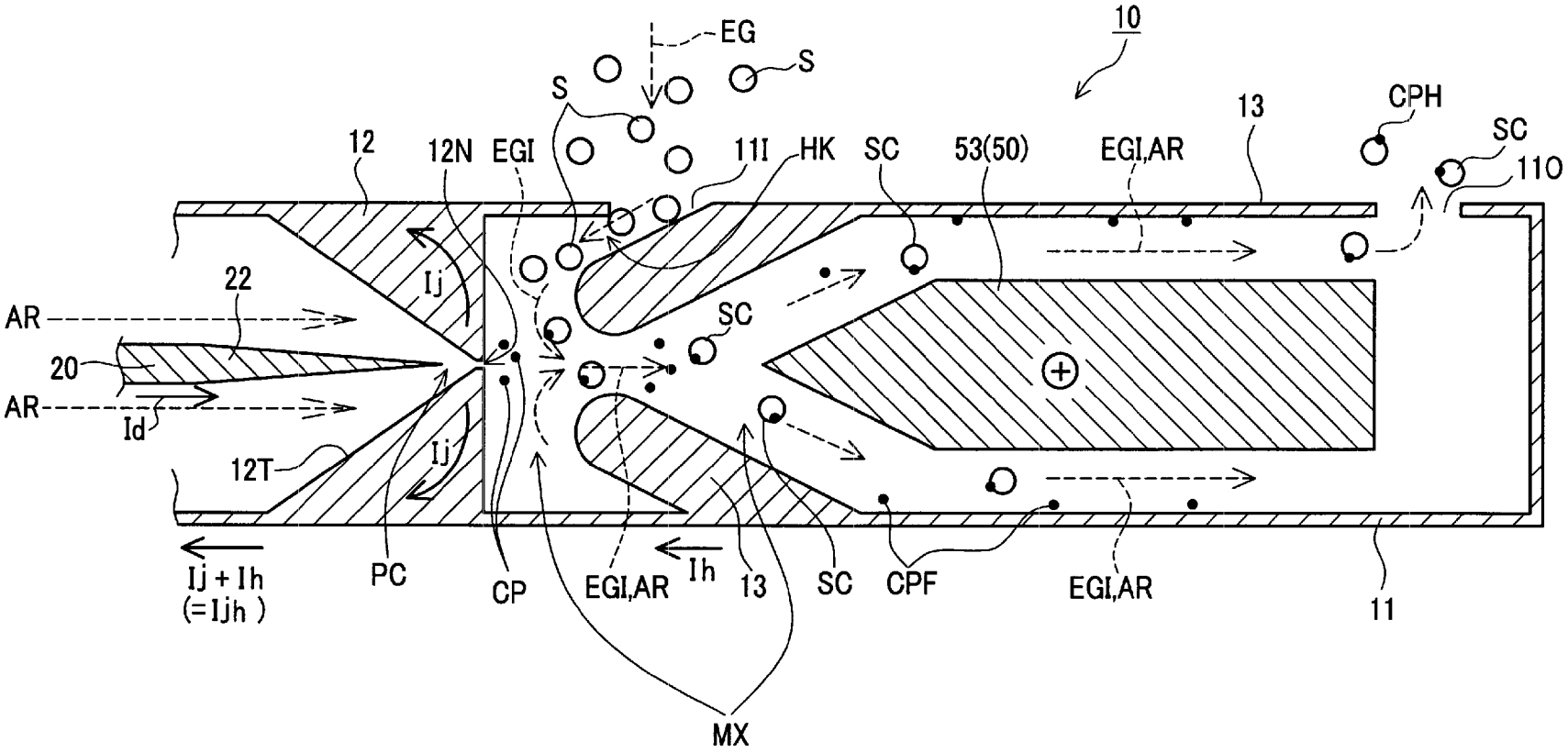
FIG. 1 is an explanatory view schematically showing introduction, charging, and release of particulates within a particulate charging section of a particulate detection system according to an embodiment of the invention.

Reference numerals and symbols used to identify various features in the drawings include the following.

BT: battery
SW: key switch
ENG: engine (internal combustion engine)
ECU: control unit
OS: outside air temperature
OT: outside air temperature information (adhesion possibility information)
GS: exhaust gas temperature sensor
GT: exhaust gas temperature information (disappearance possibility information)
EP: exhaust pipe
EG: exhaust gas
S: particulate
SC: charged particulate
CP: ion
CPF: floating ion
CPH: released ion
Ijh: received/collected current
Is: signal current
1, 2, 3: particulate detection system
10: detection section
11: detection section chassis
12: nozzle portion
13: collection electrode
20: needlelike electrode body (second electrode)
22: needlelike distal end portion
MX: mixing region
EX: exhaust passage
PV1: first floating potential
PV2: second floating potential
PV3: third floating potential
PVE: ground potential
50: auxiliary electrode body (auxiliary electrode)
53: auxiliary electrode portion (auxiliary electrode)
53S: needlelike distal end portion (of auxiliary electrode portion)
AR: air (gas)
160: cable (double wall cable, lead wire)
161: power supply line
162: auxiliary line
163: air pipe (gas feed means)
163H: gas flow passage
165: inner enclosing line
167: outer enclosing line
200: processing circuit section
201: drive processing circuit
210: ion source power supply circuit
211: first output terminal

212: second output terminal
220: measurement control circuit
IO: input output circuit (adhesion information input means, disappearance information input means)
230: signal current detection circuit
231: signal input terminal
232: ground input terminal
240: auxiliary electrode power supply circuit
241: auxiliary first output terminal
242: auxiliary second output terminal
250: power supply circuit enclosing member
251: inner metallic casing (power supply circuit enclosing member)
260: outer metallic casing
270: isolation transformer (auxiliary electrode isolation transformer)
300: feed pump (gas feed means)
310: gas feed pipe (gas feed means)
S2, S3, S11, S12, S13, S22, S23: drive start delay means
S12: period length determination means
S3, S13: period determination means
S23: determination means
T1, T2: wait time
T: elapse time

DETAILED DESCRIPTION OF THE PREFERRED EMBODIMENTS

The invention will now be described in greater detail with reference to the drawings. However, the present invention should not be construed as being limited thereto.

(First Embodiment)

First, the structure, electrical function, and operation of a detection section 10 of a particulate detection system 1 of the present embodiment will be described with reference to FIG. 1. Notably, FIG. 1 schematically shows the structure, electrical function, etc., of the detection section 10 of the present system 1 so as to facilitate understanding thereof, and some portions differ in shape from those shown in other drawings.

The detection section 10 is mainly composed of a pointed needlelike distal end portion 22 of a needlelike electrode body 20; an auxiliary electrode portion 53 of an auxiliary electrode body 50; a generally cylindrical detection section chassis 11 which surrounds these portions and whose distal end portion is inserted into an exhaust pipe EP such that its proximal end portion is not inserted into the exhaust pipe EP; and an outer enclosing member 15 (see FIG. 3) which is located outside the exhaust pipe EP and which surrounds the proximal end portion of the detection section chassis 11.

The detection section chassis 11 has a nozzle portion 12 formed on the proximal end side (left side in FIG. 1) in relation to the needlelike distal end portion 22. This nozzle portion 12 has a concave facing surface 12T which is tapered down toward the distal end side and which faces the needlelike distal end portion 22. A small hole serving as a nozzle 12N is formed at the center of the surfacing face 12T. An introduction opening 11I is formed in the side wall of the detection section chassis 11 to be located on the proximal end side (left side in FIG. 1) in relation to the nozzle portion 12. A portion of the detection section chassis 11 located on the distal end side in relation to the introduction opening 11I serves as a collection electrode 13, a portion of which bulges inward so as to narrow a flow passage for air AR, described below. Moreover, the auxiliary electrode portion 53 of the auxiliary electrode body 50 is disposed within the detection section chassis 11 such that it is insulated from the detection section chassis 11. This auxiliary electrode portion 53 also has a pointed end, and is disposed to face the proximal end side (left side in FIG. 1). Moreover, a release opening 110 is formed in the detection section chassis 11 to be located on the distal end side in relation to the auxiliary electrode portion 53.

Figure 3:
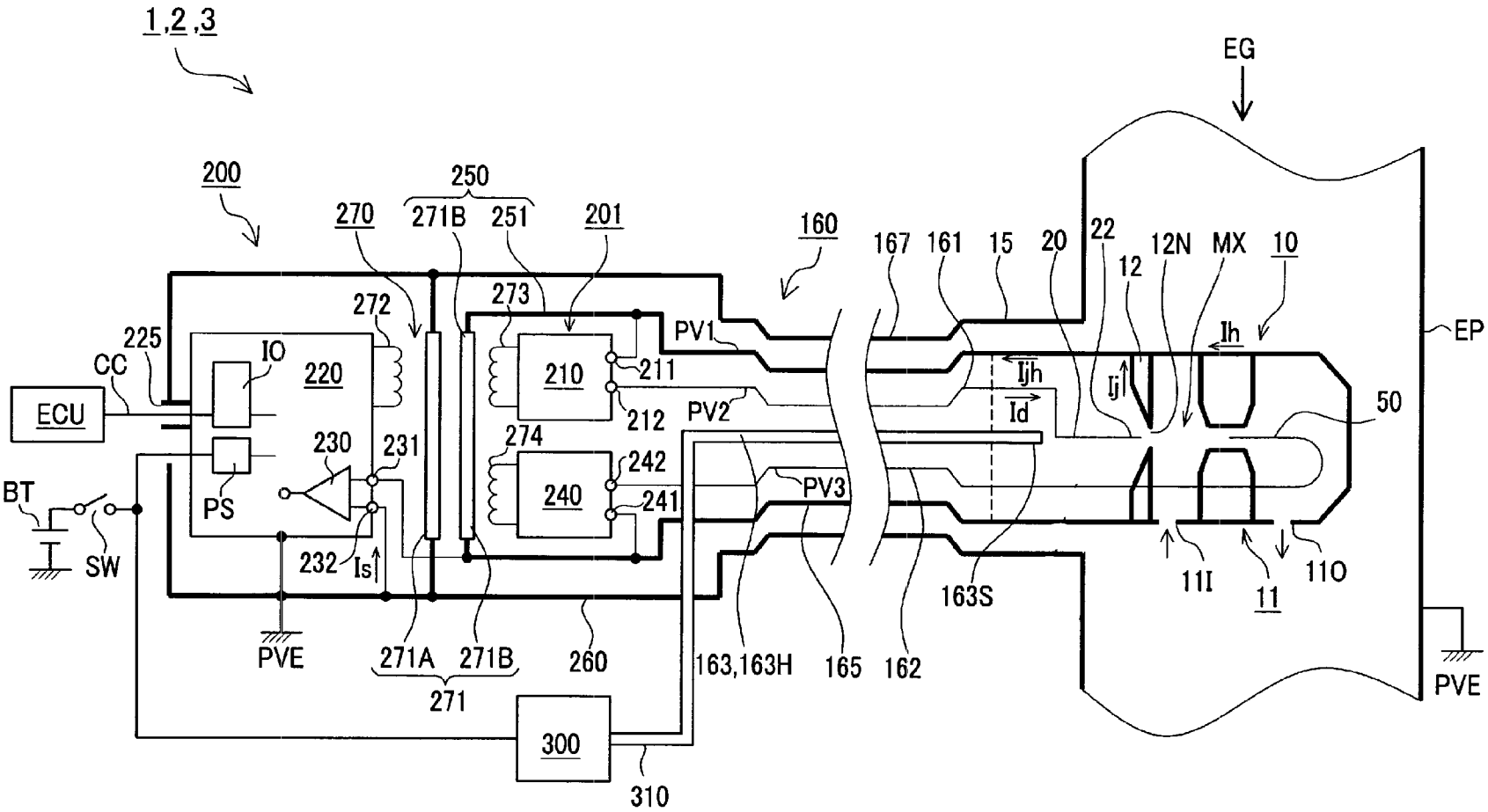
FIG. 3 is an explanatory view schematically showing the configuration of the particulate detection system according to the embodiment.

A portion of the detection section 10, which portion extends from the introduction opening 11I to the distal end (the right end in FIG. 1) of the detection section 10, is inserted into the exhaust pipe EP and is exposed to exhaust gas EG (see FIG. 3).

Meanwhile, a portion of the detection section chassis 11, which portion is located on the proximal end side (the left side in FIGS. 1 and 3) in relation to the introduction opening 11I is located outside the exhaust pipe EP. This proximal end portion is surrounded by the outer enclosing member 15, which is insulated from the detection section chassis 11, and the interior of which communicates with the exhaust pipe EP. Notably, since the exhaust pipe EP is connected to the body (ground) and is maintained at a ground potential PVE, the outer enclosing member 15 is also maintained at the ground potential PVE.

The detection section chassis 11 including the nozzle portion 12 is connected and electrically communicates, via an inner enclosing line 165 described below, with a first output terminal 211 of an ion source power supply circuit 210, an auxiliary first output terminal 241 of an auxiliary electrode power supply circuit 240, and a signal input terminal 231 of a signal current detection circuit 230, etc. These circuits will be described later. These terminals are maintained at a first floating potential PV1.

Meanwhile, the needlelike electrode body 20 (the needlelike distal end portion 22) is connected and electrically communicates, via a power supply line 161 described below, with a second output terminal 212 of the ion source power supply circuit 210, described below. Therefore, the needlelike electrode body 20 (the needlelike distal end portion 22) is maintained at a second floating potential PV2, which changes in relation to the first floating potential PV1 of the detection section chassis 11, surrounding the needlelike electrode body 20, in accordance with a positive pulse voltage (100 kHz, 1 to 2 $kV_{0\text{-}P}$) which is obtained through half-wave rectification.

Moreover, the auxiliary electrode portion 53 (the auxiliary electrode body 50) is connected and electrically communicates, via an auxiliary line 162 described below, with an auxiliary second output terminal 242 of the auxiliary electrode power supply circuit 240, described below. Therefore, the auxiliary electrode portion 53 is maintained at a third floating potential PV3, which is a DC potential that is 100 to 200 V higher than the first floating potential PV1 of the detection section chassis 11.

Accordingly, in the detection section 10, aerial discharge (specifically, corona discharge) is produced between the nozzle portion 12 (the facing surface 12T thereof) maintained at the first floating potential PV1 and the needlelike distal end portion 22 of the needlelike electrode body 20 maintained at the second floating potential PV2, which is a positive high potential in relation to the first floating potential PV1. More specifically, a positive needle corona PC is produced; i.e., corona is generated around the needlelike distal end portion 22 serving as a positive electrode. Thus, $N_2$, $O_2$, etc. contained in atmospheric gas (air) which forms the atmosphere are ionized, whereby positive ions CP are generated. The generated ions CP are partially injected toward a mixing region MX via the nozzle 12N, along with air AR supplied via an air pipe 163, described below. The injected ions CP pass through the detection section chassis 11, and are released from the release opening 110 to the interior of the exhaust pipe EP.

Also, since the pressure in the mixing region MX decreases when the air AR is injected thereinto, the exhaust gas EG is introduced from the introduction opening 11I into the mixing region MX via a lead-in passage HK. The introduced exhaust gas EGI is mixed with the air AR, and is released from the release opening 110 together with the air AR.

At that time, if the exhaust gas EG contains particulates S such as soot, as shown in FIG. 1, the particulates S are also introduced into the mixing region MX. Meanwhile, the injected air AR contains the ions CP. Therefore, the ions CP adhere to the introduced particulates S such as soot, become positively charged particulates SC, which pass through the mixing region MX, and are released from the release opening 110 together with the air AR.

Meanwhile, of the ions CP injected into the mixing region MX, floating ions CPF which have not adhered to the particulates S adhere to (are captured by) the portion of the detection section chassis 11, which portion forms the collection electrode 13 and which is maintained at the first floating potential PV1.

Notably, as described above, the auxiliary electrode portion 53 is maintained at the third floating potential PV3, which is a positive DC potential of 100 to 200 V. Thus, the floating ions CPF receive a repulsive force from the auxiliary electrode portion 53, and become more likely to be captured by the collection electrode 13.

Since the detection section 10 of the system 1 of the present embodiment is configured as described above, as a result of aerial discharge (positive needle corona discharge) between the needlelike electrode body 20 (the needlelike distal end portion 22) and the nozzle portion 12, a discharge current Id is supplied from the second output terminal 212 of the ion source power supply circuit 210 to the needlelike electrode body 20 via the power supply line 161. A large portion of this discharge current Id flows into the nozzle portion 12 (received current Ij). This received current Ij flows through the nozzle portion 12, the detection section chassis 11, and the inner enclosing line 165 (described below), and then flows into the first output terminal 211 (described below) of the ion source power supply circuit 210.

The ions CP injected from the nozzle 12N are mostly collected by the collection electrode 13 as floating ions CPF. A collected current Ih stemming from the electric charge carried by the floating ions CPF collected by the collection electrode 13 also flows into the first output terminal 211 via the inner enclosing line 165, which electrically communicates with the collection electrode 13 and the detection section chassis 11. That is, a received/collected current Ijh (=Ij+Ih), which is the sum of these currents, flows through the inner enclosing line 165.

However, this received/collected current Ijh becomes slightly smaller than the discharge current Id (Ijh<Id) because of the following reason. When the charged particulates SC are released from the release opening 110, of the ions CP injected from the nozzle 12N, release ions CPH adhering to the released, charged particulates SC: are also released. A current corresponding to the charge of the released ions (release ions) CPH does not flow as the received/collected current Ijh.

As understood from the above, the difference (=Id−Ijh) between the discharge current Id and the received/collected current Ijh corresponds to the quantity of the release ions CPH released from the detection section 10. The magnitude of the difference increases and decreases with the quantity of release ions CPH which adhere to the released, charged particulates SC and which are discharged from the detection section 10; that is, the quantity of the particulates S contained in the introduced exhaust gas EGI (the quantity of the particulates S contained in the exhaust gas EG flowing through the exhaust pipe EP). Therefore, by detecting the magnitude of the difference, the quantity of the particulates S contained in the exhaust gas EG can be detected. Notably, a method of detecting a signal current Is corresponding to the difference will be described below.

Next, the configuration of an internal combustion engine to which the present system 1 is applied will be described with reference to FIG. 2. A self-starting motor SM is provided for an engine ENG (an internal combustion engine) mounted on a vehicle (not shown). Also, the engine ENG has a cooling system CL which includes a radiator RD and cools the engine ENG through use of cooling water CLW. A water temperature sensor WS for detecting the temperature of the cooling water CLW for the engine ENG is disposed in the cooling system CL.

Moreover, an exhaust pipe EP, through which exhaust gas EG flows, extends from the engine ENG, and a filter FL and a muffler MF for purifying the exhaust gas EG are disposed in the middle of the exhaust pipe EP. An exhaust gas temperature sensor GS is disposed in the exhaust pipe EP downstream of the filter FL (upstream of the muffler MF). Further, the detection section 10 of the particulate detection system 1 is also disposed at that position. Specifically, a through hole (not shown) is formed in the side wall of the exhaust pipe EP, and an in-pipe detection portion 10N of the detection section 10, which is located on the distal end side (on the right side in FIG. 1) in relation to the introduction opening 11I of the detection section chassis 11, is inserted into the exhaust pipe EP.

Notably, the engine ENG and the exhaust pipe EP are connected to the body (ground), whereby they are maintained at the ground potential PVE.

When a key switch SW is turned from an OFF position to a start position via an ON position, the self-starting motor SM is driven by a battery BT, whereby the engine ENG is cranked. Subsequently, when complete ignition of the engine ENG occurs as a result of ignition of fuel, the key switch SW is returned to the ON position. Thereafter, the engine ENG continues its autonomous operation until the key switch SW is turned off.

A control unit ECU, which is always driven by the battery BT, is connected to the contacts of the key switch SW, and is configured such that it can detect the position of the switch SW; i.e., the OFF position, the ACC (accessories) position, the ON position, or the start position. This control unit ECU controls the engine ENG, and monitors the outputs of various sensors, such as an outside air temperature sensor OS for measuring the temperature of outside air, the water temperature sensor WS, and the exhaust gas temperature sensor GS.

Meanwhile, a processing circuit section 200 (a drive processing circuit 201) of the particulate detection system 1 is started when the key switch SW is turned to the ON position (or the start position), and performs a predetermined processing. Also, the processing circuit section 200 (the drive processing circuit 201) can communicate with the control unit ECU, and sends to the control unit ECU data regarding the quantity of particulates S detected by the particulate detection system 1.

Next, the electrical configuration and operation of the particulate detection system 1 of the present embodiment will be described with reference to FIG. 3. This system 1 is composed of the above-described detection section 10, which is attached to the exhaust pipe EP of the engine ENG mounted on a vehicle (not shown); a cable 160 extending from the detection section 10; the above-described processing circuit section 200 connected to the cable 160; and a feed pump 300 for feeding compressed air AR (see also FIG. 2). The drive processing circuit 201 of the processing circuit section 200, which is electrically connected to the detection section 10 via the cable 160, drives the detection section 10, and detects the signal current Is, described below.

First, the circuit configuration of the drive processing circuit 201 contained in the processing circuit section 200 will be described. The drive processing circuit 201 includes a measurement control circuit 220, the above-mentioned ion source power supply circuit 210, and the above-mentioned auxiliary electrode power supply circuit 240. Notably, the measurement control circuit 220 includes a signal current detection circuit 230.

The ion source power supply circuit 210 of the drive processing circuit 201 has the above-mentioned first output terminal 211 maintained at the first floating potential PV1, and the above-mentioned second output terminal 212 maintained at the second floating potential PV2. Specifically, the second floating potential PV2 changes in relation to the first floating potential PV1 in accordance with a positive pulse voltage (1 to 2 $kV_{0-p}$) which is obtained through half-wave rectification of a sinusoidal wave of about 100 kHz. Notably, the ion source power supply circuit 210 constitutes a constant-current power supply whose output current is feedback-controlled such that the output current (rms value) is autonomously maintained at a predetermined current value (in the present embodiment, 5 μA).

The auxiliary electrode power supply circuit 240 of the drive processing circuit 201 has the above-mentioned auxiliary first output terminal 241 maintained at the first floating potential PV1, and the above-mentioned auxiliary second output terminal 242 maintained at the third floating potential PV3. Specifically, the third floating potential PV3, which is a positive DC potential higher than the first floating potential PV1, is set to DC 100 to 200 V lower than the peak potential (1 to 2 kV) of the second floating potential PV2.

The signal current detection circuit 230, which partially constitutes the measurement control circuit 220 of the drive processing circuit 201, has the above-mentioned signal input terminal 231 connected to the first output terminal 211 of the ion source power supply circuit 210, and a ground input terminal 232 connected to the ground potential PVE. This signal current detection circuit 230 is a circuit for detecting the signal current Is.

In the drive processing circuit 201, the ion source power supply circuit 210 and the auxiliary electrode power supply circuit 240 are surrounded by a power supply circuit enclosing member 250, which is maintained at the first floating potential PV1, to thereby electromagnetically shield the same. The first output terminal 211 of the ion source power supply circuit 210, the auxiliary first output terminal 241 of the auxiliary electrode power supply circuit 240, and the signal input terminal 231 of the signal current detection circuit 230 are connected to the power supply circuit enclosing member 250, and are maintained at the common first floating potential PV1.

Notably, in the present embodiment, the power supply circuit enclosing member 250 is composed of an inner metallic casing 251, and a secondary-side core 271B of an isolation transformer 270. The inner metallic casing 251, which is formed of a box-shaped metallic member, accommodates and surrounds the ion source power supply circuit 210 and the auxiliary electrode power supply circuit 240, and electrically communicates with the inner enclosing line 165.

The isolation transformer 270 has a core 271, which is configured such that the core 271 can be divided into a primary-side core 271A, around which a primary-side coil 272 is wound, and the above-mentioned secondary-side core 271B, around which a power-supply-circuit-side coil 273 and an auxiliary-electrode-power-supply-side coil 274 are wound. The isolation transformer 270 is configured such that the primary-side core 271A and the secondary-side core 271B are separated from each other with a small clearance formed therebetween so as to be electrically insulated from each other. However, the primary-side core 271A and the secondary-side core 271B form a magnetic circuit such that a common magnetic flux passes through the two cores. Thus, the isolation transformer 270 provides a transformation action. Notably, of the core 271, the primary-side core 271A electrically communicates with the ground potential PVE, and the secondary-side core 271B electrically communicates with the first floating potential PV1 (the first output terminal 211 of the ion source power supply circuit 210).

Furthermore, the ion source power supply circuit 210, the auxiliary electrode power supply circuit 240, the power supply circuit enclosing member 250 (the inner metallic casing 251), and the measurement control circuit 220 including the signal current detection circuit 230 are enclosed by and accommodated in a box-shaped outer metallic casing 260, which is formed of aluminum and is grounded to thereby be maintained at the ground potential PVE. Thus, these circuits and member are shielded electromagnetically. Notably, the ground input terminal 232 of the signal current detection circuit 230 and the primary-side core 271A of the isolation transformer 270 are also connected to the outer metallic casing 260.

The measurement control circuit 220 includes a regulated power supply PS, which drives the measurement control circuit 220 (including the signal current detection circuit 230), and also drives the ion source power supply circuit 210 and the auxiliary electrode power supply circuit 240 via the isolation transformer 270. This regulated power supply PS is driven by the onboard battery BT via the key switch SW. When the key switch SW is turned to the ON position (or the start position), the regulated power supply PS operates, whereby the measurement control circuit 220 starts.

Also, the measurement control circuit 220 includes an input output circuit IO, as well as a microprocessor, ROM, and RAM, which are not shown. The ROM stores a program to be performed by the microprocessor. The measurement control circuit 220 controls its own drive, and controls the drives of the ion source power supply circuit 210 and the auxiliary electrode power supply circuit 240. Also, the input output circuit IO can communicate, via a communication cable CC, with the above-mentioned control unit ECU for controlling the engine ENG. Thus, the input output circuit IO can transmit to the control unit ECU a signal which represents the result of measurement by the above-mentioned signal current detection circuit 230 (the magnitude of the signal current Is), a value which is converted therefrom and represents the quantity of particulates, etc., or the result of a determination as to whether or not the quantity of particulates exceeds a predetermined amount. This enables the control unit ECU to control the engine ENG and perform other operations such as issuance of a warning which reports a failure of the filter FL.

Also, in the present embodiment, described below, outside air temperature information OT is transmitted from the control unit ECU to the input output circuit IO of the measurement control circuit 220 via the communication cable CC.

A portion of the electric power externally supplied to the measurement control circuit 220 via the regulated power supply PS is distributed to the ion source power supply circuit 210 and the auxiliary electrode power supply circuit 240 via the isolation transformer 270. Accordingly, the measurement control circuit 220 can start and stop the drives of the ion source power supply circuit 210 and the auxiliary electrode power supply circuit 240 by controlling (starting/stopping) the distribution of electric power to the ion source power supply circuit 210 and the auxiliary electrode power supply circuit 240.

Meanwhile, as described above, in the isolation transformer 270, the primary-side coil 272, which is a portion of the measurement control circuit 220, the power-supply-circuit-side coil 273, which is a portion of the ion source power supply circuit 210, the auxiliary-electrode-power-supply-side coil 274, which is a portion of the auxiliary electrode power supply circuit 240, and the core 271 (the primary-side core 271A and the secondary-side core 271B) are isolated from one another. Therefore, whereas electric power can be distributed from the measurement control circuit 220 to the ion source power supply circuit 210 and the auxiliary electrode power supply circuit 240, an insulating state among them can be maintained.

Figure 2:
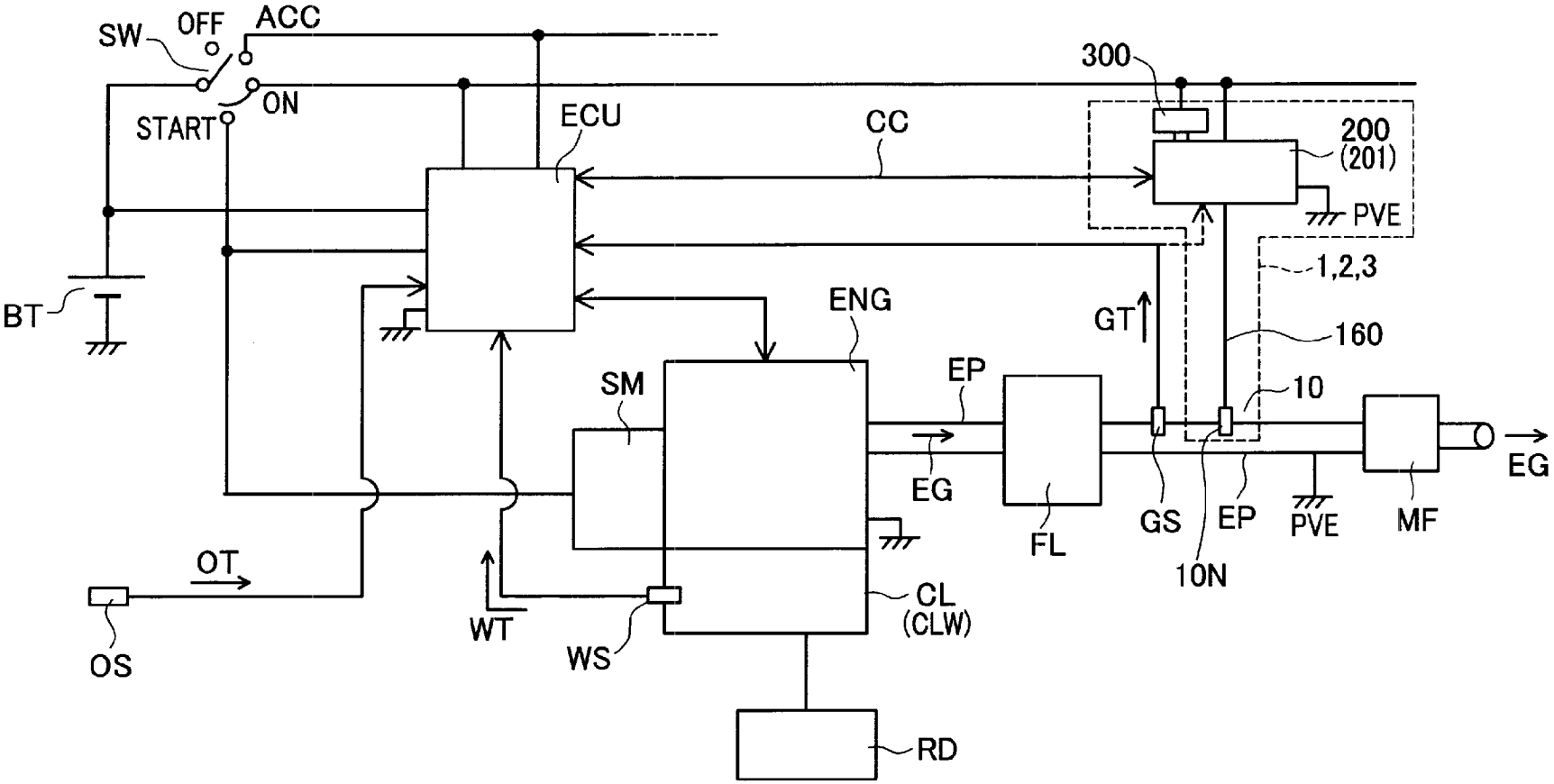
FIG. 2 is an explanatory view relating to the embodiment and schematically showing the configuration of a control system of an internal combustion engine.

Notably, the feed pump 300, which serves as gas feed means, is also driven by the onboard battery BT via the key switch SW (see also FIG. 2). Accordingly, drive of the feed pump 300 is started when the key switch SW is turned to the ON position (or the start position); i.e., before the drives of the ion source power supply circuit 210 and the auxiliary electrode power supply circuit 240 (the drive of the detection section 10) are started. Thereafter, the feed pump 300 feeds clean air AR to the vicinity of the needlelike distal end portion 22 via a gas feed pipe 310 whose distal end portion is inserted into the processing circuit section 200, and the above-mentioned air pipe 163 of the cable 160.

Next, the cable 160 will be described. This cable 160 is a double wall cable. The above-mentioned power supply line 161 and auxiliary line 162, which are formed of copper wire, and the hollow air pipe 163 (gas feed means) formed of PTFE are disposed at the center of the cable 160. The circumferences of these lines and pipe are surrounded by an insulator (not shown).

The circumference of this insulator is covered with the above-mentioned inner enclosing line 165 formed of braided thin copper wires. The circumference of the inner enclosing line 165 is covered with an insulator (not shown). The circumference of the covering insulator (cover layer) is covered with an outer enclosing line 167 formed of braided thin copper wires. The circumference of the outer enclosing line 167 is also covered with an insulator (not shown) in order to protect the outer enclosing line 167. Thus, the cable 160 has a structure such that two members; i.e., the inner enclosing line 165 and the outer enclosing line 167, surround the circumferences of the power supply line 161 and the auxiliary line 162 via the insulators.

In addition, this cable 160 enables a gas to flow in the longitudinal direction of the cable 160 through a gas flow passage 163H within the air pipe 163.

The processing circuit section 200 is connected to the cable 160 (see FIG. 3). Specifically, the second output terminal 212 of the ion source power supply circuit 210 is connected to the power supply line 161 for electrical communication therebetween. The auxiliary second output terminal 242 of the auxiliary electrode power supply circuit 240 is connected to the auxiliary line 162 for electrical communication therebetween. The first output terminal 211 of the ion source power supply circuit 210 is connected to the auxiliary first output terminal 241 of the auxiliary electrode power supply circuit 240, the signal input terminal 231 of the signal current detection circuit 230, the power supply circuit enclosing member 250, and the inner enclosing line 165 for electrical communication therebetween. The ground input terminal 232 of the signal current detection circuit 230 is connected to the ground potential PVE and the outer enclosing line 167 for electrical communication therebetween.

The gas feed pipe 310 of the feed pump 300 is inserted into the interior of the inner metallic casing 251, and is connected to the air pipe 163 of the cable 160.

Next, the relation between the cable 160 and the detection section 10 will be described.

The above-mentioned needlelike electrode body 20 is connected to the distal end (the right end in FIG. 3) of the power supply line 161 of the cable 160. This needlelike electrode body 20 is formed of tungsten wire, and has, at its distal end, the above-mentioned needlelike distal end portion 22 having a pointed shape (see FIG. 1). Therefore, the needlelike distal end portion 22 (the needlelike electrode body 20) electrically communicates, via the power supply line 161, with the second output terminal 212 of the ion source power supply circuit 210, whereby the needlelike distal end portion 22 is maintained at the second floating potential PV2.

The above-mentioned auxiliary electrode body 50, which serves as an auxiliary electrode, is connected to the distal end of the auxiliary line 162. This auxiliary electrode body 50 is formed of stainless steel wire, and its distal end portion is bent toward the proximal end to form a U-like shape, whereby the auxiliary electrode portion 53 is provided. Therefore, the auxiliary electrode portion 53 (the auxiliary electrode body 50) electrically communicates, via the auxiliary line 162, with the auxiliary second output terminal 242 of the auxiliary electrode power supply circuit 240, whereby the auxiliary electrode portion 53 is maintained at the third floating potential PV3.

The above-mentioned detection section chassis 11 is connected to the distal end of the inner enclosing line 165 of the cable 160. Therefore, the detection section chassis 11 (the nozzle portion 12 and the collection electrode 13 which form the detection section chassis 11) electrically communicates, via the inner enclosing line 165, with the first output terminal 211 of the ion source power supply circuit 210, the auxiliary first output terminal 241 of the auxiliary electrode power supply circuit 240, the signal input terminal 231 of the signal current detection circuit 230, and the power supply circuit enclosing member 250, whereby the detection section chassis 11 is maintained at the first floating potential PV1.

The outer enclosing member 15 of the detection section 10 is connected to the distal end of the outer enclosing line 167 of the cable 160. Therefore, the outer enclosing member 15 electrically communicates, via the outer enclosing line 167, with the ground input terminal 232 of the signal current detection circuit 230, and is maintained at the ground potential PVE.

The air pipe 163 of the cable 160 extends to the vicinity of the needlelike distal end portion 22 of the needlelike electrode body 20, and its distal end portion 163S is open. Therefore, the air AR can be released from the distal end portion 163S of the air pipe 163 at a position near the needlelike distal end portion 22. Notably, in order to prevent leakage of the air AR from locations other than the nozzle 12N of the nozzle portion 12, the circumference of the distal end portion 163S of the air pipe 163 is surrounded by the cable 160, the detection section chassis 11, etc.

Since the system 1 of the present embodiment is configured as described above, as having already been described with reference to FIG. 1, the discharge current Id is supplied from the second output terminal 212 of the ion source power supply circuit 210 to the needlelike distal end portion 22 via the power supply line 161 when aerial discharge occurs between the needlelike distal end portion 22 and the nozzle portion 12. A large portion of the discharge current Id flows into the nozzle portion 12 (the first electrode) (received current Ij). This received current Ij flows through the inner enclosing line 165, and then flows into the first output terminal 211 of the ion source power supply circuit 210. Meanwhile the ions CP which are generated as a result of the aerial discharge and injected are mostly collected by the collection electrode 13 as floating ions CPF. The collected current Ih stemming from the charge of the floating ions CPF collected by the collection electrode 13 also flows into the first output terminal 211 via the inner enclosing line 165, which electrically communicates with the collection electrode 13 (the detection section chassis 11). That is, the received/collected current Ijh (=Ij+Ih), which is the sum of these currents, flows through the inner enclosing line 165.

However, this received/collected current Ijh becomes smaller than the discharge current Id by a current corresponding to the charge of the release ions CPH released from the release opening 11O.

Incidentally, as viewed from the ion source power supply circuit 210, an imbalance is produced between the discharge current Id flowing out of the second output terminal 212 and the received/collected current Ijh flowing into the first output terminal 211. Therefore, a signal current Is corresponding to this shortage (the difference=the discharge current Id−the received/collected current Ijh) flows from the ground potential PVE into the first output terminal 211, whereby a balanced state is established.

In view of the above, in the present system 1, the signal current detection circuit 230 is provided, which has the signal input terminal 231 electrically communicating with the first output terminal 211, and the ground input terminal 232 electrically communicating with the ground potential PVE and which detects the current flowing between the two terminals. Thus, the signal current detection circuit 230 detects the signal current Is flowing between the first output terminal 211 and the ground potential PVE.

The magnitude of the signal current Is (=Id−Ijh) corresponding to the difference (the discharge current Id−the received/collected current Ijh) increases and decreases with the quantity of release ions CPH which adhere to the released, charged particulates SC and are discharged from the detection section 10; that is, the quantity of the particulates S contained in the introduced exhaust gas EGI (the quantity of the particulates S contained in the exhaust gas EG flowing through the exhaust pipe EP). Therefore, by detecting the magnitude of the signal current Is, the quantity of the particulates S contained in the exhaust gas EG can be detected.

Incidentally, depending on the environment in which the vehicle (the engine ENG) is placed (e.g., when the outside air temperature is low), moisture vapor contained in the exhaust gas EG may condense into water within the housing of a turbo charger (not shown) or within the exhaust pipe EP after the engine ENG is stopped. In the case of the present embodiment, condensed water may accumulate in the exhaust pipe EP in a region between the detection section 10 and the filter FL (see FIG. 2).

When the engine ENG is started again in this state, for a short time, the exhaust gas may contain not only moisture vapor but also water droplets. Accordingly, a water droplet may adhere to the in-pipe detection portion 10N of the detection section 10, which is located within the exhaust pipe EP or faces the interior of the exhaust pipe EP.

Also, condensed water may exist inside or around the detection section 10 (the in-pipe detection portion 10N) itself before the engine ENG is started.

The adhering water droplets evaporate and disappear when, upon elapse of time from startup of the engine ENG, the temperature of the engine ENG increases, or the temperatures of the exhaust pipe EP and the detection section 10 increase due to heating by the exhaust gas EG.

However, in the case where a water droplet remains on the detection section 10, depending on the position where the water droplet adheres to the detection section 10, the water droplet may lower the insulation resistance between the constituent members of the detection section 10 (for example, between the detection section chassis 11 and the outer enclosing member 15).

If electricity is supplied to the detection section 10 in a state in which the insulation resistance between the constituent members thereof has lowered; that is, if the drive of the drive processing circuit 201 (the ion source power supply circuit 210 and the auxiliary electrode power supply circuit 240) is started so as to apply a voltage to the detection section 10 in such a case, an undesirable current flows, and the load acting on the ion source power supply circuit 210 or the auxiliary electrode power supply circuit 240 may become excessive. Alternatively, operations, such as aerial discharge between the needlelike distal end portion 22 and the nozzle portion 12, become unstable, whereby proper detection of the particulates S may become impossible.

Also, since a water droplet adheres to the surface of an insulating member, which provides electrical insulation, a current may flow between members which are to be insulated from each other by the insulating member (for example, between the detection section chassis 11 and the outer enclosing member 15, which are insulated from each other by an unillustrated insulating member). In such a case, migration occurs. Specifically, the metal which constitutes the detection section chassis 11 melts, moves along the surface of the insulating member, and deposits on the outer enclosing member 15 in a dendritic shape. Thus, a current path is formed on the surface of the insulating member, and the insulation resistance permanently decreases. As a result, the path through which the received/collected current Ijh flows becomes unstable, and the function of the detection section 10 may deteriorate. Consequently, proper measurement of the signal current Is becomes impossible.

In order to solve the above-described drawback, in the present embodiment, the drives of the ion source power supply circuit 210 and the auxiliary electrode power supply circuit 240 are not started immediately after the drive processing circuit 201 of the system 1 is started as a result of the key switch SW being turned to the ON position (or the start position) (immediately after startup of the drives of the ion source power supply circuit 210 and the auxiliary electrode power supply circuit 240 in the drive processing circuit 201 becomes possible) or immediately after the startup of the engine ENG. Rather, the drives of these circuits 210 and 240 are started after an elapse of time. This wait processing will be described with reference to the flowchart of FIG. 4.

When the key switch SW is turned to the ON position (or the start position), it is detected by the control unit ECU. Also, when electric current is supplied to the drive processing circuit 201 (the measurement control circuit 220) of the present system 1 as a result of the key switch SW being turned to the ON position (or the start position), the drive processing circuit 201 starts various operations in accordance with a program stored in the drive processing circuit 201. Of the various operations, wait operation (a wait processing routine) will be described. In the wait processing routine, the measurement control circuit 220 first performs an initial setting in step S1. Specifically, for example, the measurement control circuit 220 resets an elapse time T, which is counted by a wait timer (T=0).

Next, the measurement control circuit 220 proceeds to step S2 so as to start the wait timer. In the present embodiment, the timing at which the measurement control circuit 220 has executed this step S2 is the timing at which clocking of the wait time T1 is started.

After that, in step S3, the measurement control circuit 220 determines whether or not the elapse time T of the wait timer exceeds a predetermined wait time T1 (in the present embodiment, T1=60 sec) (T>T1?). In the case where the result of the determination is "No"; that is, in the case where the elapse time T is not greater than the wait time T1 (T≤T1), the measurement control circuit 220 repeats step S3. Meanwhile, in the case where the result of the determination is "Yes"; that is, in the case where the elapse time T has exceeded the wait time T1 (T>T1), the measurement control circuit 220 proceeds to step S4.

In step S4, the measurement control circuit 220 turns on the ion source power supply circuit 210 and the auxiliary electrode power supply circuit 240; that is, starts the drives of these circuits. Specifically, the measurement control circuit 220 supplies a current to the primary-side coil 272 of the isolation transformer 270 in order to supply electric power to the ion source power supply circuit 210 and the auxiliary electrode power supply circuit 240 via the power-supply-circuit-side coil 273 and the auxiliary-electrode-power-supply-circuit-side coil 274 of the isolation transformer 270, to thereby start the operations of these power supply circuits 210 and 240. As a result, the second floating potential PV2 appears at the second output terminal 212 of the ion source power supply circuit 210, and the first floating potential PV1 appears at the first output terminal 211 of the ion source power supply circuit 210, whereby aerial discharge is produced between the needlelike distal end portion 22 and the nozzle portion 12. Meanwhile, the third floating potential PV3 appears at the auxiliary second output terminal 242 of the auxiliary electrode power supply circuit 240, whereby the auxiliary electrode portion 53 is brought to the third floating potential PV3.

Thus, in step S4, the detection section 10 starts its operation, and the signal current detection circuit 230 of the measurement control circuit 220 is enabled to detect the signal current Is corresponding to the quantity of the particulates S contained in the exhaust gas EG.

At that time, since a time longer than T1 (in the present embodiment, T1=60 sec) has already elapsed from the startup of the engine ENG, the possibility of adhesion of water droplets to the detection section 10 is low. Therefore, the signal current Is can be detected properly, and the above-described problems which occur as a result of supply of electric current to the detection section 10 in a state in which water droplets adhere thereto can be restrained or prevented.

Notably, the measurement control circuit 220 (having an unillustrated microprocessor provided therein), which executes the above-described steps S2 and S3, corresponds to the drive start delay means. Also, the measurement control circuit 220, which executes the above-described step S3, corresponds to the period determination means. The feed pump 300, the gas feed pipe 310, and the air pipe 163 correspond to the gas feed means.

In the particulate detection system 1 of the present embodiment, the drive start delay means S2, S3 delays the start of drive of the detection section 10 until a start condition (T>T1) determined in the measurement control circuit 220 of the drive processing circuit 201 is satisfied. Therefore, the problems which occur as a result of adhesion of water droplets to the detection section 10 can be restrained or prevented. This is unlike the case where the drive of the detection section 10 is started immediately after the startup of the drive processing circuit 201 and without determining whether or not operation of the engine ENG has been started or without consideration of the time elapsed after the startup of the engine ENG.

Further, in the system 1 of the present embodiment, the above-mentioned start condition employed by the drive start delay means S2, S3 is a period passage condition (T>T1) which is satisfied when the elapse time T after startup of the drive processing circuit 201 (the measurement control circuit 220) (more accurately, after execution of the above-described step S2) exceeds the wait time T1 determined by the measurement control circuit 220 of the drive processing circuit 201. The drive start delay means S2, S3 includes period determination means S3 for determining whether or not the elapse time T satisfies the period passage condition (T>T1). Therefore, in the present system 1, of the drive start delay means S2, S3, the period determination means S3 is used to wait elapse of the wait time T1. Therefore, processing is easy.

In the present system 1, the feed pump 300, the air feed 310, and the air pipe 163 for feeding external air AR to the detection section 10 are provided, and the feeding of the air AR is performed after the key switch SW is turned to the ON position (or the start position); i.e., before the drive of the detection section 10 is started. Even in the case where a water droplet is present in the detection section 10 (the in-pipe detection portion 10N), through the air feeding, the water droplet can be effectively discharged to the outside of the detection section 10, and the water droplets can be evaporated removed quickly. Thus, it becomes possible to restrain or prevent problems which are caused by water droplets remaining in the detection section 10.

In addition, through feeding of the air AR, it is possible to prevent water droplets remaining in the detection section 10 from influencing the generation of discharge, which influence would otherwise occur when the water droplets enter, via the nozzle 12N of the nozzle portion 12, the space in which corona discharge occurs (in the vicinity of the needlelike distal end portion 22 of the needlelike electrode body 20). As described above, a fault which occurs at the detection section 10 due to presence of water droplets can be prevented properly.

(First Modification)

Next, a first modification of the above-described embodiment will be described. A particulate detection system 2 of the first modification has the same mechanical and electrical configurations as those of the above-described embodiment, and attachment to the exhaust pipe EP is performed in the same manner (see FIGS. 1 to 3).

Figure 4:
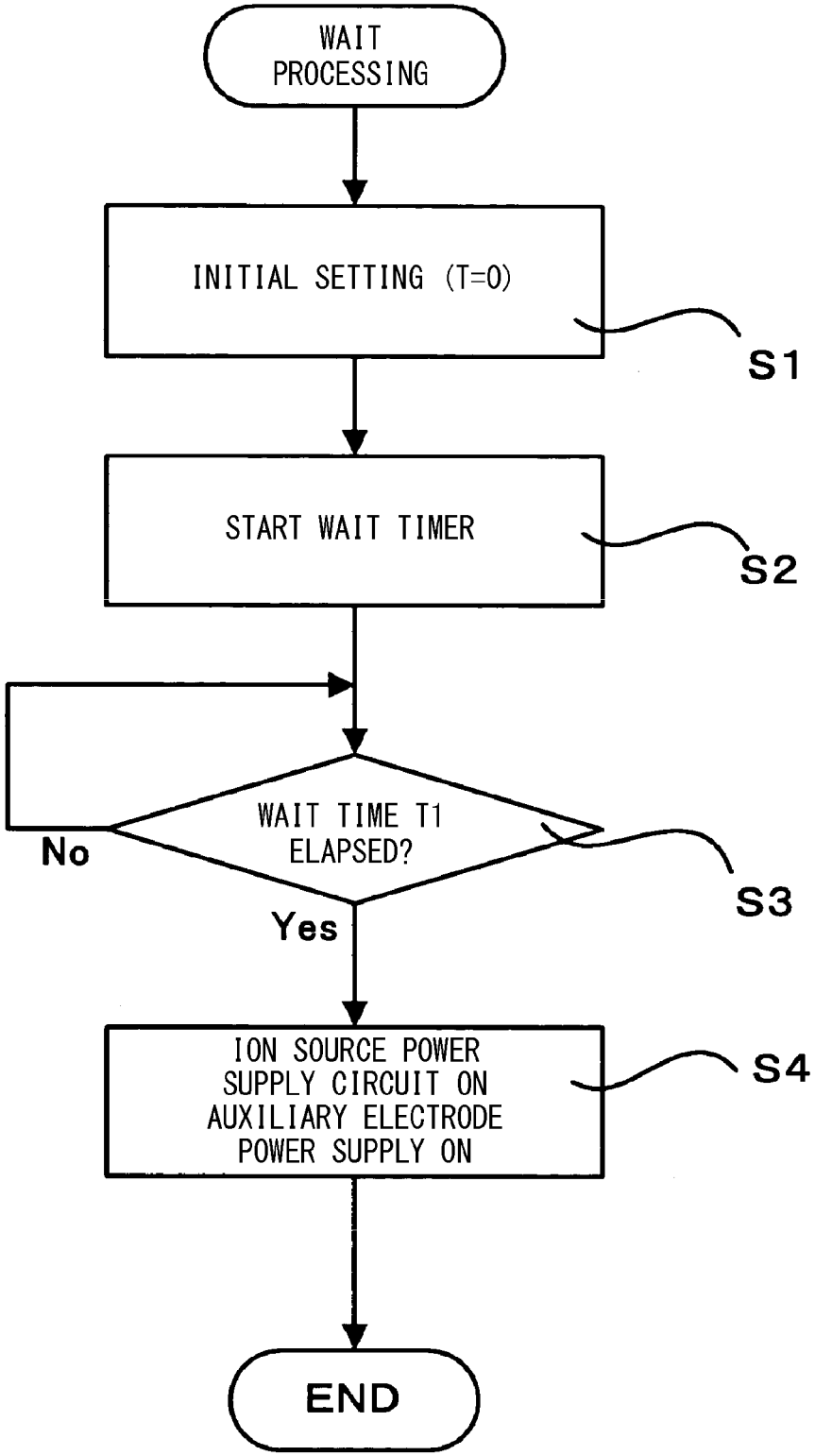
FIG. 4 is a flowchart of waiting processing of a drive processing circuit according to the embodiment.

However, the system 1 of the above-described embodiment is configured such that, in the program executed by the measurement control circuit 220 of the drive processing circuit 201 (specifically, the program stored in an unillustrated ROM and executed by an unillustrated microprocessor, which are provided in the measurement control circuit), the wait processing routine is performed in accordance with the processing flow shown in FIG. 4, and the wait time T1 used in that routine has a fixed length.

Figure 5:
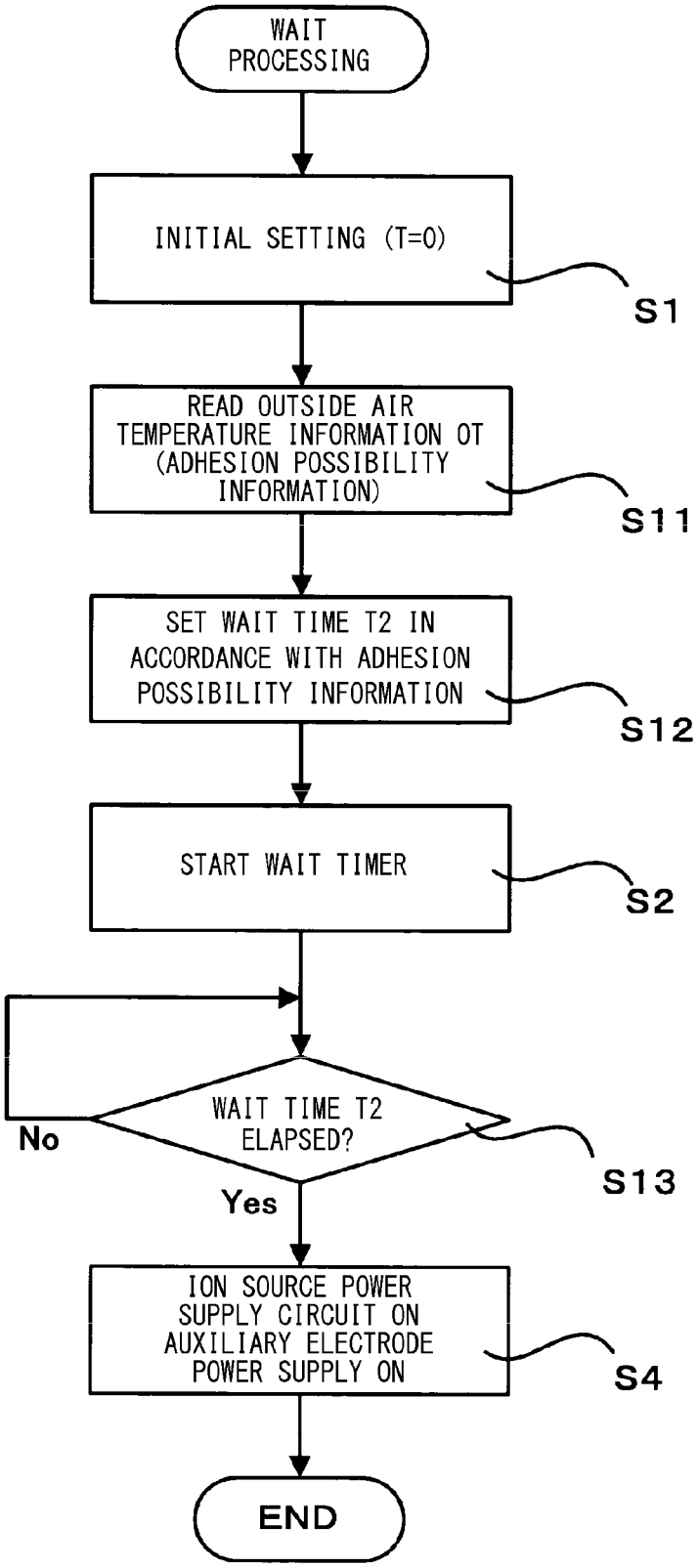
FIG. 5 is a flowchart of waiting processing of a drive processing circuit according to a first modification.

The system 2 of the present modification differs from the system 1 only in the point that the length of a wait time T2 is changed by the wait processing routine shown in FIG. 5.

Therefore, different points will mainly be described, and the description of the same or similar portions will not be repeated or will be simplified.

Notably, as in the system 1 of the above-described embodiment, the system 2 of the first modification is also configured such that the drive of the feed pump 300 is started when the key switch SW is turned to the ON position (or the start position). After that time, clean air AR is fed under pressure to the vicinity of the needlelike distal end portion 22.

The wait processing routine according to the first modification will be described with reference to FIG. 5.

When electric current is supplied to the drive processing circuit 201 (the measurement control circuit 220) of the present system 2 as a result of the key switch SW being turned to the ON position (or the start position), as in the case of the embodiment, the drive processing circuit 201 (the measurement control circuit 220) starts various operations in accordance with a program stored in the drive processing circuit 201. In the wait processing routine of FIG. 5 as well, the measurement control circuit 220 first performs initial setting in step S1. Specifically, for example, the measurement control circuit 220 resets an elapse time T, which is counted by a wait timer (T=0).

Next, in the first modification, the measurement control circuit 220 proceeds to step S11. Specifically, in first modification, as shown in FIG. 2, the outside air temperature information OT output from the outside air temperature sensor OS is first collected by the control unit ECU. The control unit ECU sends the outside air temperature information OT to the input output circuit IO of the measurement control circuit 220 via the communication cable CC.

In the case where the outside air temperature is low (for example, −10° C. or lower), the lower the outside air temperature, the higher the possibility of generation of condensed water in the exhaust pipe EP, etc. That is, the outside air temperature information OT serves as adhesion possibility information on the basis of which the possibility of adhesion of water droplets to the detection section 10 can be evaluated.

Next, in step S12, the measurement control circuit 220 sets the wait time T2, in place of the wait time T1 (=60 sec) in the embodiment, on the basis of the outside air temperature information OT (the adhesion possibility information). For example, the wait time T2 is set as follows. When the outside air temperature (the outside air temperature information OT) is equal to lower than −10° C., the wait time T2 is set to 60 sec; when the outside air temperature is 10° C. to −10° C., the wait time T2 is set to 30 sec; when the outside air temperature is 10° C. to 20° C., the wait time T2 is set to 15 sec; and when the outside air temperature is higher than 20° C., the wait time T2 is set to 0 sec (the drive is started immediately).

Next, the measurement control circuit 220 proceeds to step S2 so as to start the wait timer as in the case of the first embodiment. In the first modification as well, the timing at which the measurement control circuit 220 has executed this step S2 is the timing at which clocking of the wait time T2 is started.

After that, in step S13, the measurement control circuit 220 determines whether or not the elapse time T of the wait timer exceeds the wait time T2 set in the above-described step S12 (T>T2?). In the case where the result of the determination is "No"; that is, in the case where the elapse time T is not greater than the wait time T2 (T≤T2), the measurement control circuit 220 repeats step S13. Meanwhile, in the case where the result of the determination is "Yes"; that is, in the case where the elapse time T has exceeded the wait time T2 (T>T2), the measurement control circuit 220 proceeds to step S4.

In step S4, as in the case of the first embodiment, the measurement control circuit 220 turns on the ion source power supply circuit 210 and the auxiliary electrode power supply circuit 240; that is, starts the drives of these circuits. Notably, since this step S4 is identical to that of the embodiment having already been described, its description will not be repeated.

Thus, in step S4, the detection section 10 starts its operation, and the signal current detection circuit 230 of the measurement control circuit 220 is enabled to detect the signal current Is corresponding to the quantity of the particulates S contained in the exhaust gas EG.

At that time, a time longer than the wait time T2 has already elapsed after the startup of the engine ENG (more accurately, after the execution of the above-described step S2). The wait time T2 is set in accordance with the outside air temperature information OT (specifically, such that the higher the outside air temperature, the shorter the wait time T2). Therefore, in the first modification as well, after elapse of the wait time T2, the possibility of adhesion of water droplets to the detection section 10 is low. Therefore, the signal current Is can be detected properly, and problems which occur as a result of supply of electric current to the detection section 10 in a state in which water droplets adhere thereto can be restrained or prevented. In addition, unlike the embodiment in which the fixed wait time T1 is used, in the first modification, the length (the end) of the wait time T2 is changed in accordance with the outside air temperature information OT. Therefore, in the case where the outside air temperature is high and the possibility of generation of condensed water is therefore low, the wait time T2 can be shortened. Thus, it becomes possible to detect particulates by the present system 2 at an early timing while restraining or preventing the occurrence of problems caused by adhesion of condensed water to the detection section 10.

Notably, in the first modification, the measurement control circuit 220 (having an unillustrated microprocessor provided therein), which executes the above-described steps S11, S12, S2 and S13, corresponds to the drive start delay means. Also, the measurement control circuit 220, which executes the above-described step S13, corresponds to the period determination means.

Moreover, the input output circuit IO of the drive processing circuit 201 (the measurement control circuit 220) corresponds to the adhesion information input means. Also, the measurement control circuit 220, which executes the above-described step S12, corresponds to the wait length determination means.

In the particulate detection system 2 of the first modification, the drive processing circuit 201 (the measurement control circuit 220) includes the input output circuit IO, and the drive start delay means S11, S12, S2, S13 includes the wait length determination means S12. Therefore, the length of the wait time T2 can be properly determined on the basis of the outside air temperature information OT from the outside air temperature sensor OS. Thus, it becomes possible to start the drive of the detection section 10 at a proper timing as early as possible, while restraining or preventing the occurrence of problems caused by adhesion of water droplets to the detection section 10.

Notably, in the first modification, the outside air temperature information OT from the outside air temperature sensor OS is used as the adhesion possibility information which allows the evaluation of the possibility of adhesion of water droplets to the detection section 10. However, other types of information may be used, such as water temperature information WT from the water temperature sensor WS of the engine ENG, which allows the evaluation of the possibility of generation of condensed water or the possibility of adhesion of water droplets to the detection section 10 (the in-pipe detection portion 10N). In the case where a detection section temperature sensor for detecting the temperature of the detection section 10 is provided separately, detection section temperature information from this detection section temperature sensor may be used. Accordingly, the length (end) of the wait time T2 may be determined through use of information from these sensors. Moreover, the length (end) of the wait time T2 may be determined through combined use of these adhesion possibility information data.

The first modification employs an information route designed such that the outside air temperature information OT from the outside air temperature sensor OS is first received by the control unit ECU, and is then transmitted from the control unit ECU to the input output circuit IO of the drive processing circuit 201 (the measurement control circuit 220) via the communication cable CC. Similar to this, an information route for transmitting information to the input output circuit IO of the measurement control circuit 220 via the control unit ECU may be employed for other information data, such as water temperature information WT from the water temperature sensor WS. Alternatively, an information route for transmitting the outside air temperature information OT from the outside air temperature sensor OS directly to the input output circuit IO of the measurement control circuit 220 may be employed. Similarly, the water temperature information WT and the temperature information from the temperature sensor of the detection section 10 may be transmitted directly to the measurement control circuit 220.

(Second Modification)

Next, a second modification of the above-described embodiment will be described. A particulate detection system 3 of the second modification has the same mechanical and electrical configurations as those of the above-described embodiment and the first modification, and the attachment to the exhaust pipe EP is performed in the same manner (see FIGS. 1 to 3).

However, system 1 of the embodiment and system 2 of the first medication are configured such that, in the program executed by the measurement control circuit 220 of the drive processing circuit 201 (specifically, the program stored in an unillustrated ROM and executed by an unillustrated microprocessor, which are provided in the measurement control circuit), the wait processing routine is performed in accordance with the processing flow shown in FIG. 4 or FIG. 5. Notably, in the embodiment, the length of the wait time T1 is fixed. In the first modification, the length of the wait time T2 is determined in step S12 in advance. That is, in the embodiment and the first modification, the lengths of the wait times T1 and T2 are determined in advance.

Figure 6:
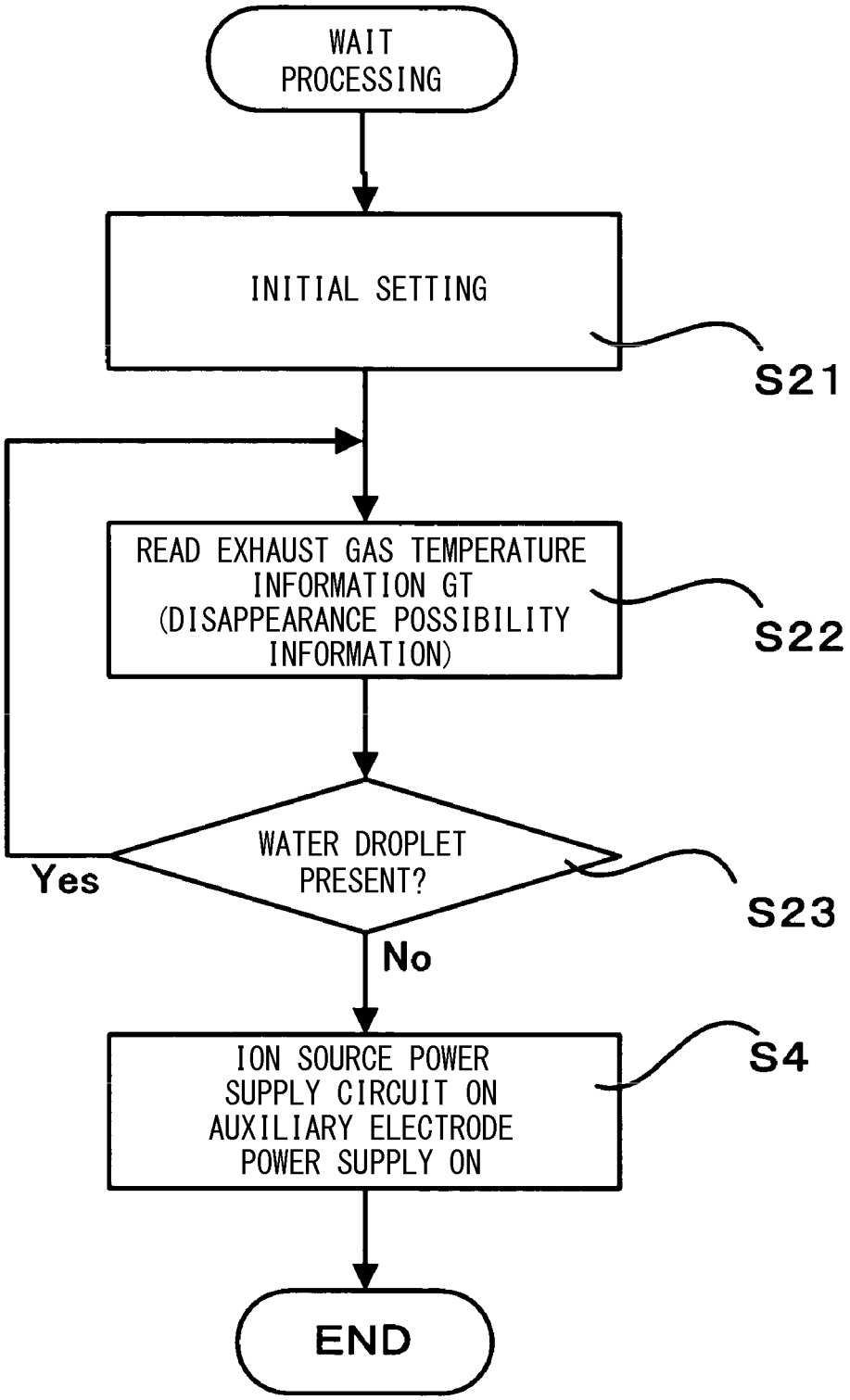
FIG. 6 is a flowchart of waiting processing of a drive processing circuit according to a second modification.

The system 3 of the second modification differs from the systems 1 and 2 in the point that the wait time is not determined, but the end of the wait processing is determined at each time point by the wait processing routine shown in FIG. 6. Therefore, the difference from the embodiment and the first modification will mainly be described, and the description of the same or similar portions will not be repeated or will be simplified.

Notably, as in the system 1 of the embodiment and the system 2 of the first modification, the system 3 of the second modification is also configured such that the drive of the feed pump 300 is started when the key switch SW is turned to the ON position (or the start position), and, after that time, clean air AR is fed under pressure to the vicinity of the needlelike distal end portion 22.

The wait processing routine according to the second modification will be described with reference to FIG. 6.

When electric current is supplied to the drive processing circuit 201 (the measurement control circuit 220) of the present system 3 as a result of the key switch SW being turned to the ON position (or the start position), as in the case of the embodiment and the first modification, the drive processing circuit 201 (the measurement control circuit 220) starts various operations in accordance with a program stored in the drive processing circuit 201. In the wait processing routine of FIG. 6 as well, the measurement control circuit 220 first performs an initial setting in step S21. Specifically, for example, the measurement control circuit 220 resets exhaust gas temperature information GT from the exhaust gas temperature sensor GS.

Next, in the second modification, the measurement control circuit 220 proceeds to step S22. Specifically, in the second modification, as shown in FIG. 2, the exhaust gas temperature information GT output from the exhaust gas temperature sensor GS is first collected by the control unit ECU. The control unit ECU sends the exhaust gas temperature information GT to the input output circuit IO of the measurement control circuit 220 via the communication cable CC.

In the case where the exhaust gas temperature is low (for example, lower than 100° C.), the exhaust pipe EP has not yet been heated sufficiently. Therefore, condensed water remains without evaporating, and exhaust gas contains water droplets. Therefore, water droplets may newly adhere to the detection section 10. Also, condensed water may adhere to the detection section 10 without evaporating. That is, the exhaust gas temperature information GT serves as disappearance possibility information which allows evaluation of the possibility of disappearance of water droplets adhering to the detection section 10.

Next, in step S23, the measurement control circuit 220 evaluates the possibility of adhesion of water droplets to the detection section 10 on the basis of the exhaust gas temperature information GT (the disappearance possibility information). For example, when the exhaust gas temperature (the exhaust gas temperature information GT) of the exhaust gas EG indicated by the exhaust gas temperature sensor GS shown in FIG. 2 is 100° C. or higher, the measurement control circuit 220 determines that no water droplets adhere to the detection section 10. Meanwhile, when the exhaust gas temperature is lower than 100° C., the measurement control circuit 220 determines that water droplets may adhere to the detection section 10 ("a water droplet is present").

In the case where the measurement control circuit 220 makes a "Yes" determination; that is, determines that a "water droplet is present" (GT<100° C.) in step S23, the measurement control circuit 220 repeats step S23. Meanwhile, in the case where the measurement control circuit 220 makes a "No" determination; that is, does not determine that "a water droplet is present" (determines that no water droplet is present) (GT≥100° C.), the measurement control circuit 220 proceeds to step S4.

In step S4, as in the case of the embodiment and the first modification, the measurement control circuit 22 turns on the ion source power supply circuit 210 and the auxiliary electrode power supply circuit 240. That is, the measurement control circuit 22 starts the drives of these circuits. Notably, since this step S4 is identical to that of the first embodiment having been described already, its description will not be repeated.

Thus, in step S4, the detection section 10 starts its operation, and the signal current detection circuit 230 of the measurement control circuit 220 is enabled to detect the signal current Is corresponding to the quantity of the particulates S contained in the exhaust gas EG.

At that time, the exhaust gas temperature (exhaust gas temperature information GT) becomes equal to or higher than 100° C., and the possibility of adhesion of water droplets to the detection section 10 is low. Therefore, the signal current Is can be detected properly, and the above-described problems which occur as a result of supply of electric current to the detection section 10 in a state in which water droplets adhere thereto can be restrained or prevented. In addition, unlike the embodiment in which the fixed wait time T1 is used and the first modification in which the length (the end) of the wait time T2 is set in advance, the length of the wait time is determined in accordance with the exhaust gas temperature information GT output from the exhaust gas temperature sensor GS. Thus, the wait time can be ended properly. Therefore, it becomes possible to detect particulates by the present system 3 at an early timing while restraining or preventing the occurrence of problems caused by adhesion of condensed water to the detection section 10.

Notably, in the second modification, the measurement control circuit 220 (having an unillustrated microprocessor provided therein), which executes the above-described steps S22, S23 corresponds to the drive start delay means.

Moreover, the input output circuit IO of the drive processing circuit 201 (the measurement control circuit 220) corresponds to the disappearance information input means. Also, the measurement control circuit 220, which executes the above-described step S23, corresponds to the determination means.

As described above, in the present particulate detection system 3, the drive processing circuit 201 (the measurement control circuit 220) includes the input output circuit IO, and the drive start delay means S22, S23 includes the determination means S23. Therefore, in the present system 3, the determination as to whether to start the drive of the detection section 10 can be made on the basis of the exhaust gas temperature information GT (the disappearance possibility information). Thus, it becomes possible to start the drive of the detection section 10 at a proper timing as early as possible, while restraining or preventing the occurrence of problems caused by adhesion of water droplets to the detection section 10.

Notably, in the second modification, the exhaust gas temperature information GT from the exhaust gas temperature sensor GS is used as the disappearance possibility information which allows evaluation of the possibility of disappearance of water droplets adhering to the detection section 10. However, other types of information may be used, such as the water temperature information WT from the water temperature sensor WS of the engine ENG, which allows an estimate to be made as to whether condensed water adhering to the detection section 10 has decreased or disappeared due to an increase in the engine temperature after startup of the engine ENG. Also, the detection section temperature information from the detection section temperature sensor which detects the temperature of the detection section 10 may be used.

The end of the wait time may be determined through use of the disappearance possibility information from these sensors. Moreover, the end of the wait time may be determined through combined use of these disappearance possibility information data from the various sensors.

Furthermore, the disappearance possibility information may be combined with the adhesion possibility information, such as the outside air temperature information OT from the outside air temperature sensor OS, which allows an estimate to be made of the generation of condensed water.

In the second modification, the exhaust gas temperature information GT output from the exhaust gas temperature sensor GS is first received by the control unit ECU, and is then transmitted from the control unit ECU to the input output circuit IO of the drive processing circuit 201 (the measurement control circuit 220) via the communication cable CC. Similar to this, an information route for transmitting information to the input output circuit IO of the measurement control circuit 220 via the control unit ECU may be employed for the water temperature information WT from the water temperature sensor WS.

Alternatively, as indicated by a broken line in FIG. 2, an information route may be employed for transmitting the exhaust gas temperature information GT from the exhaust gas temperature sensor GS directly to the input output circuit IO of the measurement control circuit 220. Similarly, the water temperature information WT may be transmitted directly to the measurement control circuit 220.

The present invention has been described in detail with reference to the above embodiment and modifications. However, the present invention should not be construed as being limited thereto. It should further be apparent to those skilled in the art that various changes in form and detail of the invention as shown and described above may be made. It is intended that such changes be included within the spirit and scope of the claims appended hereto.

For example, in the embodiment, etc., the detection section 10 of the systems 1 to 3 is disposed in the exhaust pipe EP to be located downstream of the filter FL (upstream of the muffler MF) (see FIG. 2). However, a configuration may be employed such that the detection section 10 is disposed upstream of the filter FL so as to directly detect particulates S contained in the exhaust gas EG from the engine ENG.

In the embodiment, etc., when the key switch SW is turned to the ON position (or the start position), the feed pump 300 starts its operation so as to start the feeding of air simultaneously with or independently of the startup of the system 1, etc. (the drive processing circuit 201). However, the drive of the feed pump 300 may be controlled by the drive processing circuit 201. Specifically, the drive of the feed pump 300 may be started simultaneously with the startup of the engine ENG, at a predetermined timing after the startup of the drive processing circuit 201, or at a predetermined timing after the startup of the engine ENG. However, preferably, the feeding of air is started as early as possible, because water droplets adhering to the detection section 10 (the in-pipe detection portion 10N) can be readily removed at an earlier timing.

Moreover, in the embodiment, etc., the detection section 10 and the processing circuit section 200 (the drive processing circuit 201) are disposed such that they are remote from each other, and are connected together via the cable 160, which includes the power supply line 161, the auxiliary line 162, etc. However, the entirety of an integral type particulate detection system including a detection section and a processing circuit section (a drive processing circuit) integrated together may be attached to the exhaust pipe EP.

This application is based on Japanese Patent application No. JP 2011-106662 filed May 11, 2011, incorporated herein by reference in its entirety.

What is claimed is:

1. A particulate detection system for detecting a quantity of particulates contained in exhaust gas which is discharged from an internal combustion engine and flows through an exhaust pipe, comprising:

a detection section for generating an output signal corresponding to the quantity of particulates contained in the exhaust gas, the detection section being attached to the exhaust pipe; and a drive processing circuit electrically connected to the detection section, driving the detection section, and detecting and processing the output signal from the detection section, wherein the drive processing circuit includes a measurement control circuit for delaying start of the driving of the detection section without driving the detection section until a start condition determined by the drive processing circuit is satisfied after startup of the internal combustion engine.

2. The particulate detection system as claimed in claim 1, wherein the start condition is a period passage condition which is satisfied when a time elapsed after startup of the drive processing circuit exceeds a wait time determined by the drive processing circuit; and the measurement control circuit determines whether or not the period passage condition is satisfied by determining whether or not the elapse time exceeds the wait time.

3. The particulate detection system as claimed in claim 2, wherein the measurement control circuit receives adhesion possibility information output from a sensor, evaluates the possibility of adhesion of water droplets to the detection section on the basis of the adhesion possibility information, and determines a length of the wait time associated with the period passage condition on the basis of the evaluation.

4. The particulate detection system as claimed in claim 1, wherein the measurement control circuit receives disappearance possibility information output from a sensor, evaluates the possibility of disappearance of water droplets adhering to the detection section on the basis of the disappearance possibility information, and determines whether or not the start condition is satisfied on the basis of the evaluation.

5. The particulate detection system as claimed in claim 1, further comprising gas feed means for feeding a gas to an in-pipe detection portion of the detection section, which portion is located within the exhaust pipe or faces the interior of the exhaust pipe, wherein the gas feed means starts feeding of the gas before the detection section is driven.

6. The particulate detection system as claimed in claim 1, wherein the driving the detection section comprises supplying power to the detection section, and wherein the detection section generates the output signal in response to receiving the supplied power.

7. The particulate detection system as claimed in claim 1, wherein the detection section comprises:

a needle shaped distal end portion of a first electrode;

an auxiliary electrode portion of an auxiliary electrode; and a cylindrical detection chassis, wherein the needle shaped distal end portion and the auxiliary electrode portion are disposed within the cylindrical detection chassis.

* * * * *